United States Patent [19]

Paskert

[11] 4,000,543

[45] Jan. 4, 1977

[54] MONITOR ACTUATING DEVICE AND REUSABLE FASTENER THEREFOR

[75] Inventor: Joseph H. Paskert, Lakewood, Ohio

[73] Assignee: Eaton Corporation, Cleveland, Ohio

[22] Filed: Dec. 2, 1975

[21] Appl. No.: 636,867

[52] U.S. Cl. ..... 24/150 R

[51] Int. Cl.[2] ..... A44B 9/00

[58] Field of Search ..... 24/150 R, 150 FP, 155 R, 24/155 BB, 155 RB, 155 BR, 90 E, 90 F, 90 PR

[56] References Cited

UNITED STATES PATENTS

| | | | |
|---|---|---|---|
| 405,529 | 6/1889 | Bryant | 24/90 PR |
| 464,149 | 12/1891 | Cook | 24/90 PR |
| 999,079 | 7/1911 | Worzen | 24/155 RB |
| 1,020,653 | 3/1912 | Mueller | 24/155 RB |
| 1,078,683 | 11/1913 | Judia | 24/155 RB |
| 1,152,892 | 9/1915 | Henry | 24/155 BB |
| 3,261,067 | 7/1966 | Ikeda | 24/155 BR |
| 3,911,534 | 10/1975 | Martens | 24/150 R |

*Primary Examiner*—Donald A. Griffin
*Attorney, Agent, or Firm*—Teagno & Toddy

[57] ABSTRACT

A monitor actuating device and a releasable, reusable fastener therefor is provided. The monitor actuating device is designed for attachment to a monitored article and for release therefrom only by the use of a specially designed tool. The actuating device includes a pin member, such as a headed tack or the like, extending therefrom and/or therethrough, which is designed to pierce the monitored article, such as an article of clothing or the like. The reusable fastener is selectively attachable to the free end of the pin member to capture the monitored article and/or the monitor actuating device on the pin and to prevent removal of the monitored article and/or the monitor actuating device for the pin. The reusable fastener is designed for release from the pin only upon the use of a special tool to prevent, or at least render more difficult, the unauthorized removal of the monitor actuating device from the monitored article. The fastener includes a body, preferably plastic, in which a resilient spring steel clip is mounted. The body defines a pin receiving bore and the clip includes a resilient cantilever mounted tongue in acute angular relation to a plane normal to the axis of the bore. The tongue includes an aperture sized to receive the pin which, in the nondeformed position of the tongue, is in nonregistering partial alignment with the bore and has a projection on a plane normal to the axis of the bore which has at least one dimension smaller than the diameter of the pin. The aperture will register with the bore and have a projection on a plane normal to the axis of the bore substantially equal to or greater than the diameter of the pin when the tongue is resiliently deformed to be generally normal to the axis of the bore. The body includes an axially movable portion for resiliently urging said tongue towards a normal to the axis of the bore position.

27 Claims, 13 Drawing Figures

FIG. 3A
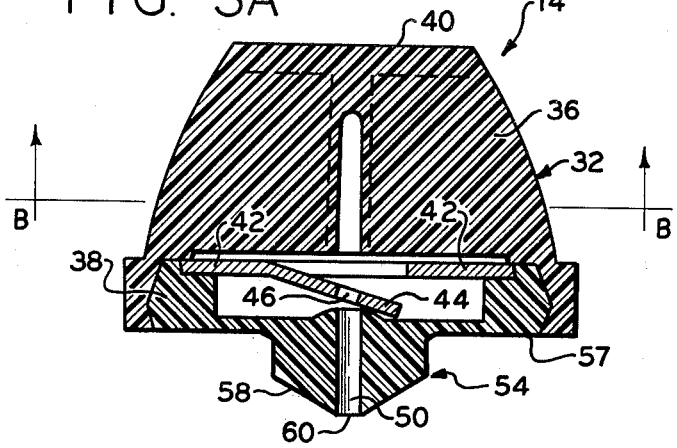
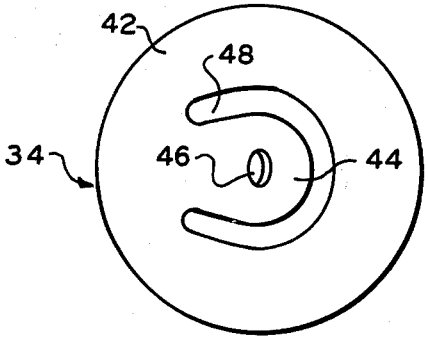
FIG. 5
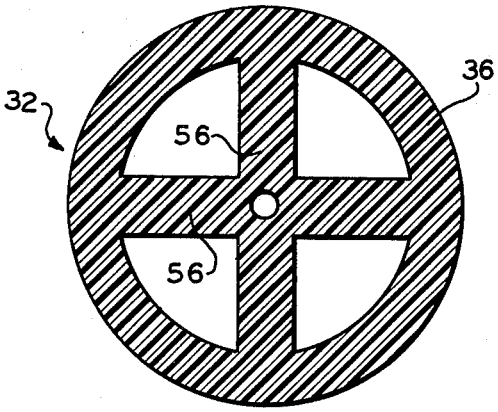
FIG. 3B
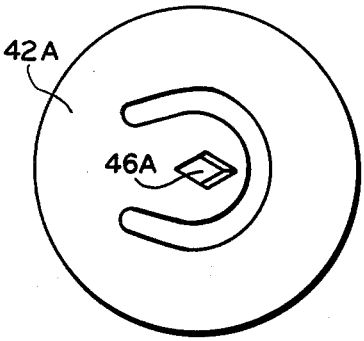
FIG. 6
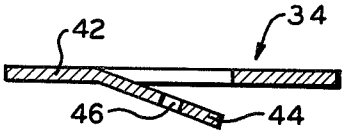
FIG. 4
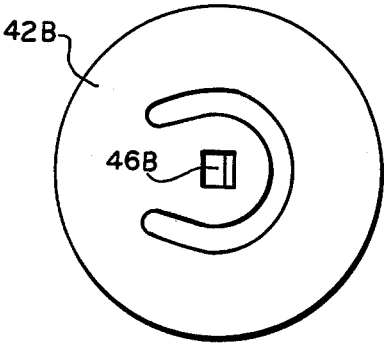
FIG. 7

MONITOR ACTUATING DEVICE AND REUSABLE FASTENER THEREFOR

BACKGROUND OF THE INVENTION

1. Field of the Invention

This invention relates to monitor actuating devices and reusable fasteners therefor and more particularly to reusable fasteners which are selectively removably attachable to pin members extending through a monitored article and through and/or from a monitor actuating device to capture the article and/or actuating device on the pin and which are designed to be nondestructively releasable from the pin only upon the use of a special tool.

2. Description of the Prior Art

The use of monitor actuating devices such as alarms and alarm-activating members attached to articles to signal the unauthorized removal of said articles beyond a monitored point is or from an authorized area is known in the art. Several of these anti-pilferage or anti-shoplifting systems are described in some detail in U.S. Pat. Nos. 3,665,448; 3,631,442; 3,577,136 and others. In general, the systems comprise a monitor activating device such as a magnet, a miniature circuit, a radio transmitter, or the like which may be releasably attached to an article and a monitoring device which will sound an alarm and/or take a photograph if the activating device is sensed at the monitoring point. The monitoring point is usually located at or beyond the exit of a store, or other designated area. In theory, the activating devices should be easily attached to the articles, easily removed by authorized personnel having the proper equipment and very difficult to remove without the proper equipment, especially for the amateur shoplifter who is responsible for the major portion of shoplifting losses. The activating devices should also be reusable and non-destructive to the articles to which they are attached. The specially provided tool should be difficult to simulate with commonly available articles such as pocketknives, screwdrivers or the like and the tool should also be large enough to attract attention in the event of unauthorized use and should be permanently mountable at an authorized use point, such as a cash register or the like.

Several devices have been utilized in the prior art to attach such activating devices to articles to be protected. Heat-releasable devices of both the melted member type and the bi-metallic lever type have been utilized. These heat-releasable devices have not been totally satisfactory as they have not always been reusable, they are relatively expensive to manufacture, they are somewhat difficult and time consuming to remove and they require a heat-generating tool which may injure the article, the activating member and/or the user.

Devices utilizing special keys have also been used. These devices have proven relatively expense, the keys have proven relatively easy to be misplaced, and the devices have been subject to shoplifters who are somewhat more accustomed to violating key operated devices.

Devices utilizing sensors such as described in U.S. Pat. No. 3,665,448, which signal when the actuating device is removed have also been used. These devices are not totally satisfactory as they require complicated monitoring apparatus, the system must be completely or partially de-activated during authorized removal after payment and removal within the confines of the store will activate the alarm while not necessarily signaling an illegal event which may tend to cause confusion, legal liability and/or non-use of the system.

Releasably attachable clips such as are seen in U.S. Pat. No. 3,914,829 and/or allowed application Ser. No. 497,589 filed Aug. 15, 1974 by the Applicant of this invention and assigned to the assignee of this invention have proved satisfactory for many uses. However, these devices involve the use of fasteners which are integral with the monitor actuating mechanism and/or devices wherein two sections each carry complementary mating locking portions and thus the monitor actuating mechanism must be replaced in the event of damage to or loss of a portion of the devices.

SUMMARY OF THE INVENTION

In accordance with the present invention, the drawbacks of the prior art have been overcome to the extent that an inexpensively produced, reusable fastener which may be selectively attached to a pin extending from and/or through a monitor actuating device is supplied. The fastener is preferably separate from and independent of the monitor actuating device and is designed for release from a pin which pierces a monitored article and attaches the article to the actuating device only upon the use of a special tool. The fastener includes a body defining a pin receiving bore and a spring steel clip rotatably mounted in the body. The clip includes a base member axially fixed in the body and a resilient cantilever mounted tongue which extends towards the opening to the bore in an acute angle relative with respect to a plane normal to the axis of the bore. The tongue includes an aperture sized to receive the pin which, in the nondeformed position of the tongue, is partially out of register with the bore and has a projection on a plane normal to the axis of the bore which has at least one dimension smaller than the diameter of the pin to be received. The aperture will substantially register with the bore and the projection of the aperture on a plane normal to the axis of the bore will be at least as large as the cross-section of the pin when the tongue is deformed to be substantially normal to the axis of the bore. The clip is rotatable relative to the body to prevent the clip from being removed by simple twisting of the fastener. Attempts to axially move the fastener by simply axially forcing the clip from the pin will result in further tightening of the clip on a received pin as the tongue will be forced further from a normal to the axis of the bore position. The body of the clip includes an axially movable portion which will bear upon the tongue and force the tongue towards a normal to the axis of the bore position. The axially movable member is movable relative to the remainder of the body by use of a special tool which will apply an axial force to the top of the body and a lateral radially inwardly directed force to the sides of the body adjacent the bottom thereof.

Accordingly, it is an object of the present invention to provide a new and improved reusable fastener for attachment to a pin and designed for nondestructive removal from the pin only upon the use of a specially configured tool.

Another object of the present invention is to provide an improved monitor actuating device including a pin extended therethrough and/or therefrom and a reusable fastener attachable to the pin and releasable only upon the use of a special tool.

A further object of the present invention is to provide a monitor actuating system including a monitor actuator, a pin member extending through and/or from the monitor actuator for piercing the monitored article, a reusable fastener for attachment to the pin and a specialized tool for the selective removal of the fastener from the pin.

These and other objects and advantages of the present invention may be more fully appreciated by a reading of the following description of the preferred embodiment taken in connection with the attached drawings.

FIG. 3 is a front elevational view in section of the reusable fastener of the present invention.

FIG. 4 is a front view in section of the spring steel clip of the present invention.

FIG. 5 is a top view of the spring steel clip of FIG. 4.

FIGS. 6 and 7 are partial top views of alternate embodiments of spring steel clips.

DESCRIPTION OF THE PREFERRED EMBODIMENT

Figure 1:
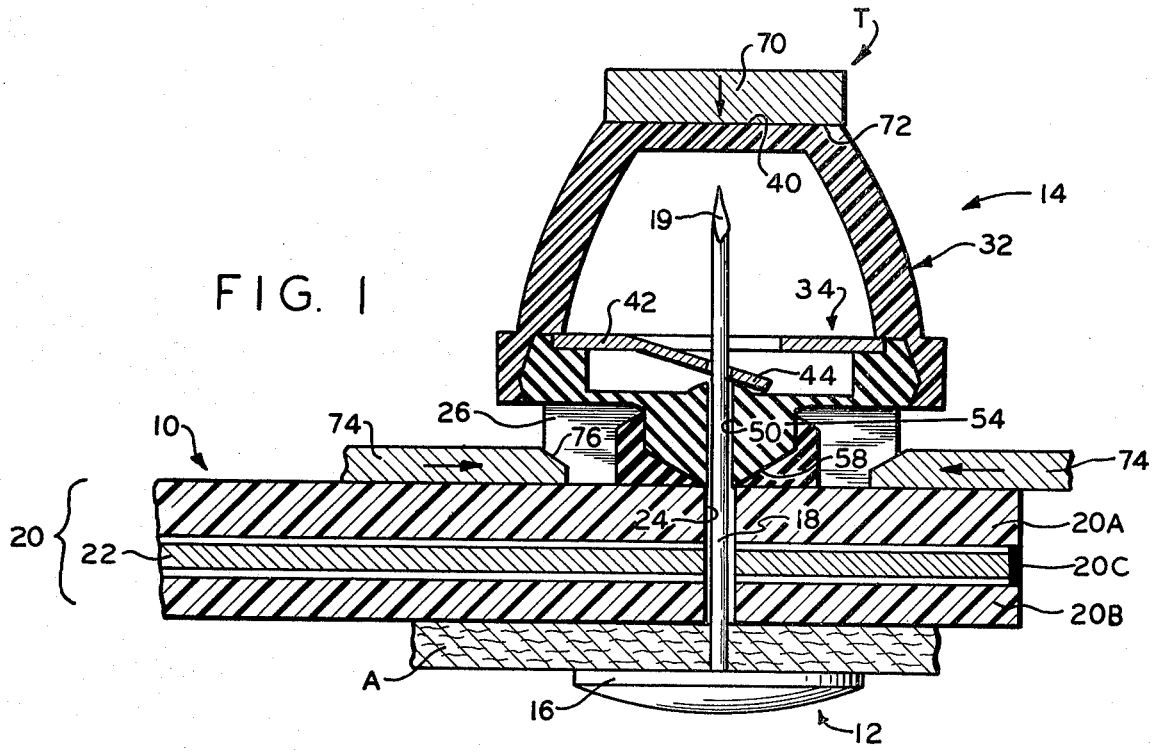
FIG. 1 is a front elevational view in partial section of the monitor actuating system of the present invention including a headed pin piercing a monitored article and extending through a monitor actuating device, a reusable fastener attached to the pin for retaining the monitored article and the monitor actuating device on the pin and the specialized tool for removal of fastener from the pin.
Figure 2:
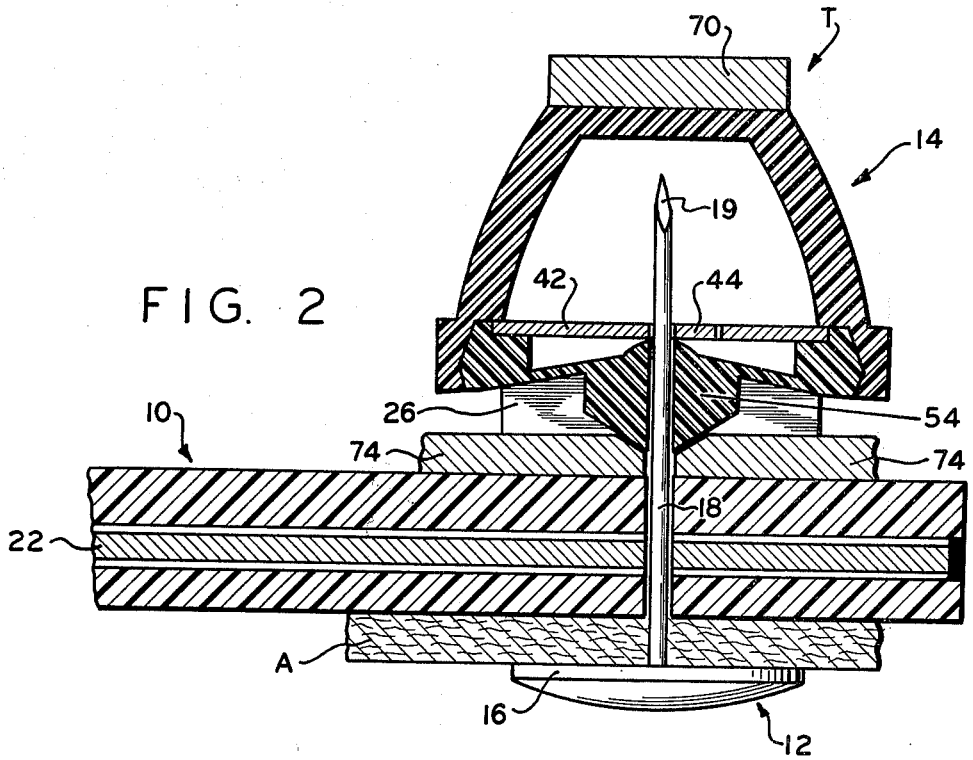
FIG. 2 is a side elevational view of the pin, monitor actuating device, monitored article and reusable fastener of FIG. 1.
Figure 11:
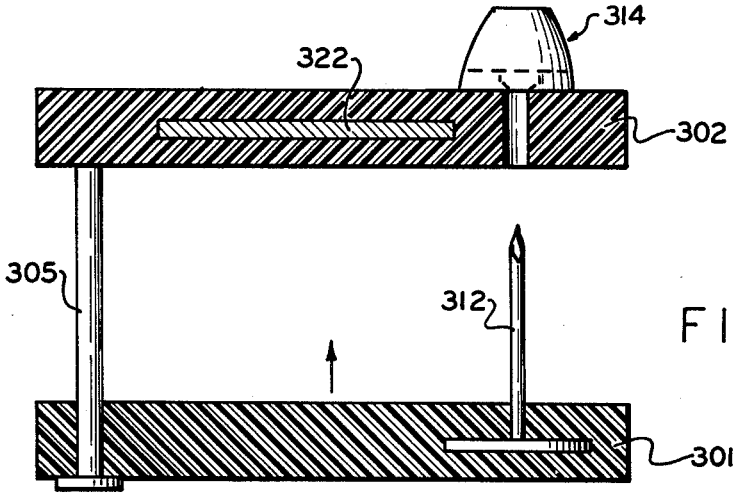
FIG. 11 is a front elevational view of another alternate embodiment of the present invention.
Figure 12:
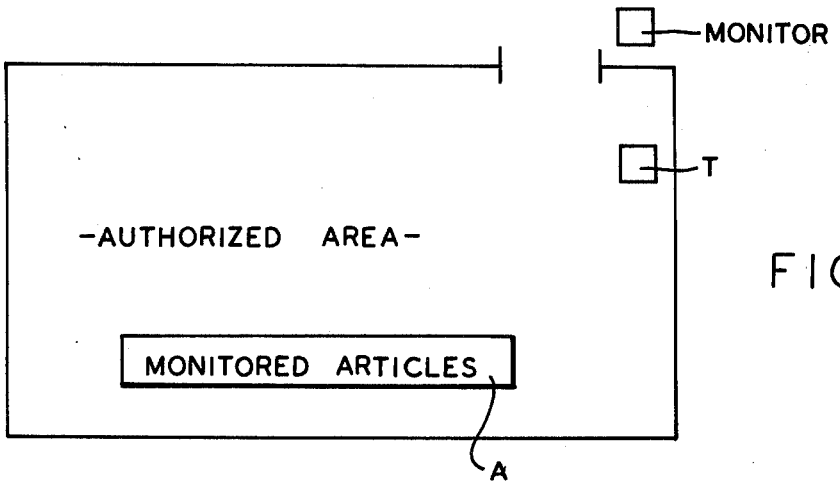
FIG. 12 is a schematic floor plan of a store or the like utilizing the monitor actuating system of the present invention.

The monitor actuating system of the present invention may be seen by reference to FIGS. 1, 2 and 11. In FIG. 1 a monitored article A, such as an article of fabric clothing or other nondestructively pierceable object, is attached to a monitor actuating device 10 by means of a headed pin 12, such as a thumb tack, which pierces the article A, passes through the monitor actuating device 12 and on which reusable fastener 14 is attached preventing removal of the article A or the actuating device 10 from the pin 12. A floor plan of a typical store utilizing the monitor actuating system may be seen by reference to FIG. 12.

The headed pin 12, which may be in the form of a conventional tack or the like comprises an enlarged head 16 and an axially extending shaft 18 of sufficient length to pierce the monitored article A, pass through the monitor actuating device 10 and be received by the fastener 14. The free end 20 of the shaft 18 opposite the head 16 is preferably pointed to facilitate piercing of monitored objects.

The monitor actuating device 10 includes a case 20 which is preferably tough and resilient to prevent vandalism and a sensor actuating member or means 22 encapsulated within the case. The sensor actuating member may be a magnet, a radio transmitter, a radio antenna or similar device as is well known in the art. A passage 24 through the actuating device is provided for passage of the pin shaft 18. One side of the case 20 may include a pair of substantially parallel rails, 26 and 28, defining a slot 30 therebetween (see FIG. 2). Passage 24 opens to the slot 30 for reasons to be described in greater detail below. It has been found that a plastic case 20 comprising two substantially identical sections 20A and 20B joined by ultrasonic welding as at 20C provides a monitor actuating device which is both durable and economically produced.

The reusable fastener 14 may be seen in greater detail by reference to FIGS. 3–7. The fastener 14 comprises a body 32 and a resilient spring steel clip 34 mounted therein. The body is preferably a two piece molded structure comprising an upper dome shaped portion 36 and a lower cam portion 38 ultrasonically welded thereto. The dome shaped portion 36 preferably has a relatively flat upper surface 40 for reasons to be discussed in detail below.

The resilient spring clip 34 includes a relatively flat base portion 42 and a resilient cantilever mounted tongue 44 extending in acute angular relation therefrom. An aperture 46 is formed in the tongue 44. The base portion 42 is preferably substantially round and the aperture is preferably located generally at least partially aligned with the axis of rotation of the clip 34 allowing the clip to be rotatably received with the fastener body 32. The tongue 44 is preferably formed by cutting a generally U-shaped groove 38 in base portion of the spring clip 34.

The base 42 of spring clip 34 is axially restrained relative to a pin shaft receiving bore 50 formed in the lower cam portion 38 of the body and may be further axially restrained relative to the body by means of a spider structure 52 which may be formed in the dome shaped portion 36. As has been indicated above, the clip 34 is preferably free to rotate relative to the body 32.

The lower cam portion 38 of body 32 includes an axially movable tubular member 54 about which an optional rubber gasket 56 or similar resilient gasket may be attached. The pin shaft receiving bore 50 is formed within the axially movable tubular member 54 and a cam surface 58 is formed on the exterior thereof. The cam surface is generally radially inwardly tapered away from the spring steel clip 34. It is noted that a radially inwardly directed pressure on cam surface 58 will tend to force axially movable member 54 towards surface 40 of the dome portion 36. The lower cam portion includes a generally flat bottom surface 57 from which tubular member 54 downwardly extends.

The resilient spring clip 34 is mounted within the body 32 such that the base portion 42 is axially fixed relative to the body and the resilient cantilevered mounted tongue 44 extends towards the opening 60 to the pin shaft receiving bore 50. The base 42 of the clip 34 is generally normal to the axis of bore 50 and the tongue 44 defines an acute angle 62 with respect to a plane normal to axis of the bore 50 and with respect to the base portion 42. It is noted that axially movable tubular portion 54 is engageable with tongue 44 and that upward motion of the axially movable portion 44 relative to surface 40 will result in the tongue 44 being resiliently deformed towards a normal to axis of bore 50 position.

The aperture 46 is, in the undeformed portion of the tongue 44, only partially aligned in registration with bore 50 and has a projection on a plane normal to the axis of bore 50 which has at least one dimension smaller than the diameter of the shaft 18. Upon deformation of the tongue 44 to a position substantially normal to the axis of bore 50, the aperture 46 will generally register with bore 50 and will have a projection on a plane normal to the axis of bore 50 which is at least as large as the cross section of pin shaft 18.

As may be seen by reference to FIGS. 1 and 2, insertion of a pin shaft 18 into bore 50 will result in the shaft engaging the aperture 46 partially registered with the bore and the tongue 44 will be resiliently deformed to a normal to the axis of the bore 50 position as the shaft is inserted into the aperture. After insertion of the shaft 18, the tongue will resiliently return towards its acute angle relation with respect to a plane normal to the axis of the bore 50 and the edges of the tongue defining aperture 46 will engage and/or penetrate shaft 18 to retain fastener 14 on pin shaft 18. It is noted that attempts to simply axially force fastener 14 from pin shaft 18 will result in tongue 44 being further displaced with respect to a plane normal to axis of bore 50 and more tightly engage shaft 18.

A specially designed tool T is utilized to remove the reusable fastener 14 from the pin shaft 18 for authorized removal of the monitor actuating device 10 from the monitored article A. The tool T comprises a static pressure point member 70 having a flat surface 72 for engagement with the flat surface 40 of dome portion 32 and at least two movable release jaws 74 which are selectively movable along a plane generally parallel to surface 72 towards and away from one another. The jaws have opposed tapered edges 76, generally complementary to the cam surface 56, which will engage the cam surface and force the axially movable portion 54 of the body towards the flat top 40 of dome 36 causing the axially movable portion to engage the resilient tongue 44 and force the tongue towards a normal to the axis of bore 50 position for release of the pin shaft 18. Preferably, the jaws 74 will be sized for sliding receipt between the ribs 26 and between the surface of case 20 and the bottom surface 57 of fastener 14.

Alternate embodiments of the aperture 46 may be seen in FIGS. 6 and 7 wherein a diamond shaped aperture 46A and a square shaped aperture 46B are illustrated. It is appreciated that while a cross-sectionally generally circular pin shaft and a generally round aperture are contemplated, applicant's invention is also suitable for various shapes of pin shafts and/or aperture shapes.

It is also understood that the terms upper, lower, top, bottom, upward, downward and the like are used herein s illustrative terms referring to the drawings and are not intended to limit the scope of the present invention.

Figure 8:
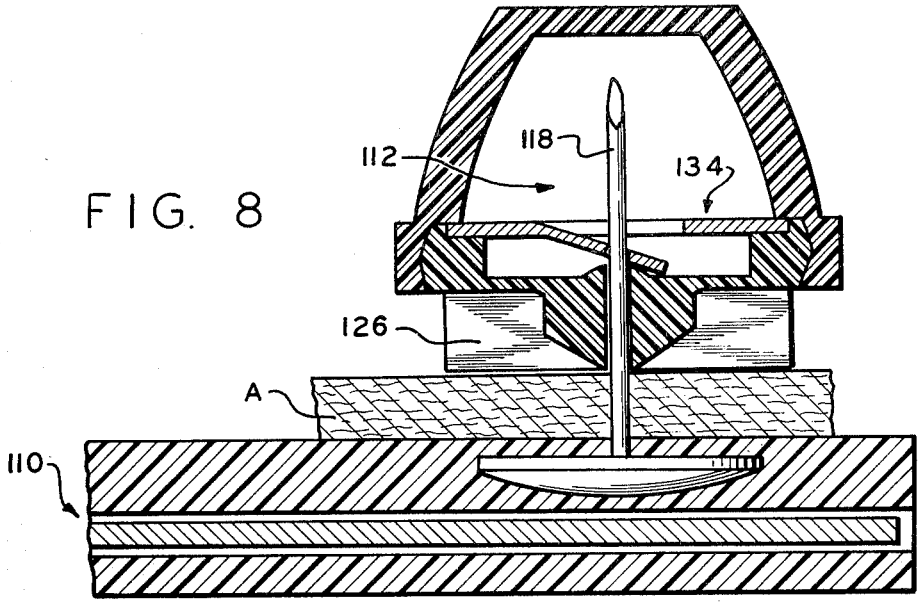
FIG. 8 is a front elevational view in section of an alternate monitor actuating system wherein the pin extends from the monitor actuating device.
Figure 9:
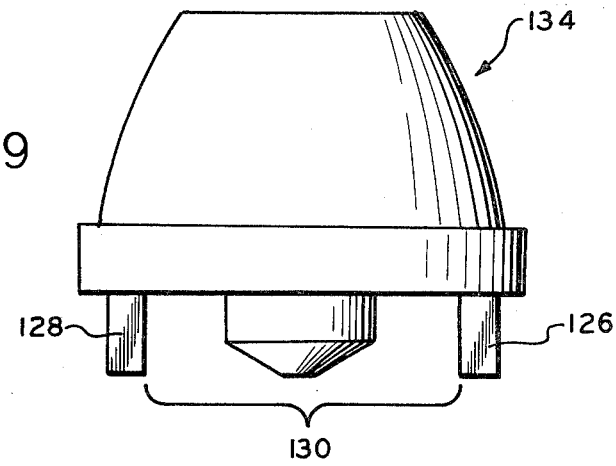
FIG. 9 is a side elevational view in section of the reusable fastener utilized with the monitor actuating system of FIG. 8.

An alternate embodiment of the present invention may be seen by reference to FIGS. 8 and 9. The monitor actuating device and reusable releasable fastener are similar in both operation and structure to that described in FIGS. 1–5 above. The pin 112 is integral with and extends from the monitor actuating device 110. The pierceable monitored article is captured on the pin shaft 118 inbetween the actuator 118 and the reusable fastener 114. The functional operation of the spring steel clip 134 and the tool T for use therewith is identical to that described for the fastener 34 shown in FIG. 1 and will not be described again in detail. A pair of generally parallel rails 126 and 128 extend from the fastener 114 for contact with the article A and for defining a slot 130 therebetween for receipt of the jaws 74 of tool T for authorized removal of the fastener 114 from pin 112 to allow the actuating device 110 to be released from the monitored article A.

Figure 10:
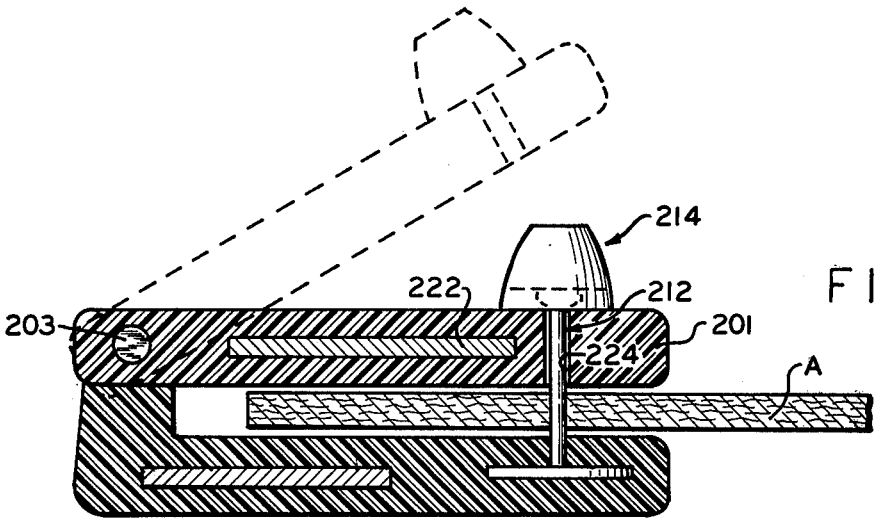
FIG. 10 is a front elevational view, in section, of an alternate embodiment of the present invention.

Another alternate embodiment of the present invention may be seen by reference to FIG. 10. In FIG. 10 the pierceable monitored article A is captured on a pin 212 which extends from an arm 201 by a fastener 214 which is attached to an arm 202 which is pivotably attached to arm 201 as at 203 which may be a pivot point, a live hinge or the like. The actuating member 222 may be mounted in either arm, 201 or 202. The release and engagement mechanism and operation of fastener 214 is substantially identical to that of fastener 14 described above. The passage 224 through arm 201 may be outwardly flared as at 204 to better receive the pin 212 as the arms 201 and 202 are pivoted together. The open, or monitor actuating device release position of the embodiment 200 is illustrated in broken lines.

In FIG. 11 a further alternate embodiment of the present invention is illustrated. An arm 301 carrying pin 312 is slidably movable on rod 305 towards and away from arm 302 which carries the fastener 314. The release and engagement mechanism and operation of fastener 314 to selectively capture an article A on the pin 312 is substantially identical to that of fastener 14 described above.

Although this invention has been described in its preferred embodiments with a certain degree of particularity, it is understood that the present disclosure of the preferred form is made by way of example and numerous changes and modifications in the details of construction and arrangement of the part is possible without departing from the spirit and scope of the invention as hereinafter claimed.

I claim:

1. A reusable fastener for attachment to the end of a shaft, said fastener comprising:

a generally hollow body having an upper generally dome shaped portion and a lower portion, said lower portion defining a bore opening to the bottom surface of said lower portion for receipt of the shaft, said lower portion including a generally tubular member at least partially defining the bore adjacent the opening thereto axially movable relative to the dome shaped portion, said tubular member having an outer cam surface tapered radially inwardly and towards the opening to the bore, radially inwardly directed force on said cam surface being effective to move said member towards said dome shaped portion; and a resilient one-piece spring steel clip mounted within said body, said clip having a base axially fixed and freely rotatable relative to said dome shaped portion, said base being generally annular in cross-section and the axis of rotation of the base being substantially coaxial with the axis of the bore, said clip having an aperture therethrough sized to receive said shaft, said clip having a first non-deformed position in which said aperture will not register with said bore and a second resiliently deformed position in which said aperture will substantially register with said bore, said axially movable tubular member being engageable with said clip to urge said clip towards said second position when said tubular member is moved axially towards said dome shaped portion.

2. A reusable fastener for attachment to the end of a shaft, said fastener comprising:

a generally hollow body having an upper generally dome shaped portion and a lower portion, said lower portion defining a bore opening to the bottom surface of said lower portion for receipt of the shaft, said lower portion including a generally tubular member at least partially defining the bore adjacent the opening thereto axially movable relative to the dome shaped portion, said tubular member having an outer cam surface tapered radially inwardly and towards the opening to the bore, radially inwardly directed force on said cam surface being effective to move said member towards said dome shaped portion; and a resilient one-piece spring steel clip mounted within said body, said clip having a base axially fixed and freely rotatable relative to said dome shaped portion, and a resilient cantilever mounted tongue extending towards said opening to said bore, said tongue normally defining an acute included angle with a plane normal to the axis of the bore, said tongue having an aperture therethrough sized to receive said shaft, said aperture being only partially registered with said bore and having a projection on a plane normal to the axis of the bore having at least one dimension smaller than the corresponding cross-sectional dimension of the shaft to be received when the tongue is in the undeformed position, said aperture substantially registering with the bore and having a projection on a plane normal to the axis of the bore at least as large as the cross-section of the shaft to be received when the tongue is deformed to be substantially normal to the axis of the bore, said base being generally annular in cross-section and the axis of rotation thereof being substantially coaxial with the axis of the bore, said aperture being at least partially registered with the axis of rotation of said base, said axially movable tubular member being engageable with said tongue to urge said tongue upwardly towards a normal to axis of the bore position when said tubular is moved axially towards said dome shaped portion.

3. The fastener of claim 2 wherein said body is formed of at least two molded pieces joined by ultrasonic welding, the upper portion of said dome shaped portion aligned with the axis of the bore including a flat surface generally normal to the axis of the bore.

4. The fastener of claim 2 wherein said lower portion of said body includes a generally flat bottom surface generally normal to the axis of the bore, a portion of said tubular member extending axially downwardly from said bottom surface, said cam surface being located on that portion of the tubular member extending downward from said bottom surface.

5. A monitor actuating device attachment assembly comprising:

a monitor actuating device, a pin member attachable to the monitor actuating device having a shaft for piercing a monitored article; and a reusable fastener for selective attachment to the free end of the shaft of the pin member to capture the monitored article on the pin member shaft, said fastener comprising a body having an upper portion and a lower portion, said lower portion defining a bore opening to the exterior surface of the lower portion for receipt of the shaft, said lower portion including a member being axially movable relative to the upper portion and having an outer cam surface tapered radially inwardly and away from the upper portion, radially inwardly directed force on said cam surface being effective to move said axially movable member towards said upper portion; and a resilient spring steel clip mounted within said body, said clip having a base axially fixed and freely rotatable relative to the upper portion and a resilient cantilever mounted tongue extending towards said opening to said bore, said tongue normally defining an acute included angle with a plane normal to the axis of the bore, said tongue having an aperture therethrough sized to receive said shaft, said aperture being only partially registered with said bore and having a projection on a plane normal to the axis of the bore having at least one dimension smaller than the corresponding cross-sectional dimension of the shaft when the tongue is in the undeformed position, said aperture substantially registering with the bore and having a projection on a plane normal to the axis of the bore at least as large as the cross-section of the shaft when the tongue is deformed to be substantially normal to the axis of the bore, said axially movable member being engageable with said tongue to urge said tongue toward a substantially normal to axis of the base position when said member is moved towards said upper portion.

6. The assembly of claim 5 wherein said monitor actuating device comprises a molded shell encapsulating a monitor actuating means, said pin being integral with and extending from said shell.

7. The assembly of claim 5 wherein said pin is a headed tack and said monitor actuating device comprises a molded shell encapsulating a monitor actuating means, said shell defining a passage therethrough sized to receive said shaft.

8. The assembly of claim 5 wherein said pin extends from the free end of a first elongated member pivotably attached to a second elongated member, said fastener attached to the free end of said second elongated member, said shaft and said bore being substantially equally spaced from the pivot point, said monitor actuating device comprising a monitor actuating means encapsulated in one of said elongated members.

9. The assembly of claim 5 wherein said pin extends from the free end of a first elongated member and said fastener is attached to the free end of a second elongated member, said first and second members being slidably attached to a rod member extending generally parallel to the axis of the shaft of the pin for relative motion towards and away from the other member.

10. A monitor actuating device attachment assembly comprising;

a pin member having a headed portion and a shaft, the free end of the shaft portion being pointed for piercing a monitored article, a monitor actuating device comprising a shell encapsulating a monitor actuating means, said shell having a passage therethrough sized to receive said shaft, and a reusable fastener for selective attachment to the free end of the shaft to capture said monitor actuating device and said monitored article on said shaft inbetween said headed portion and said fastener, said fastener comprising:

a generally hollow body having an upper generally dome shaped portion and a lower portion, said lower portion defining a bore opening to the bottom of said lower portion for receipt of the shaft, said lower portion including a generally tubular member at least partially defining the bore adjacent the opening thereto axially movable relative to the dome shaped portion, said tubular member having an outer cam surface tapered radially inwardly and towards the opening to the bore, radially inwardly directed force on said cam surface being effective to move said member towards said dome shaped portion, the bottom of said lower portion of said body including a generally flat surface generally normal to the axis of said bore, a portion of said tubular member extending axially downwardly from said lower portion bottom surface, of said cam surface located on that part of the tubular member extending downwardly from said lower portion bottom surface; and a resilient one-piece spring steel clip mounted within said body, said clip having a base axially fixed and freely rotatable relative to said dome shaped portion and a resilient cantilever mounted tongue extending towards said opening to said bore, said tongue normally defining an acute included angle with a plane normal to the axis of the bore, said tongue having an aperture therethrough sized to receive said shaft, said aperture being only partially registered with said bore and having a projection on a plane normal to the axis of the bore having at least one dimension smaller than the corresponding cross-sectional dimension of the shaft to be received when the tongue is in the undeformed position, said aperture substantially registering with the bore and having a projection on a plane normal to the axis of the bore at least as large as the cross-section of the shaft to be received when the tongue is deformed to be substantially normal to the axis of the bore, said base being generally annular in cross-section and the axis of rotation thereof being substantially coaxial with the axis of the bore, said aperture being at least partially registered with the axis of rotation of said base, said axially movable tubular member being engageable with said tongue to urge said tongue upwardly towards a normal to the axis of the bore position when said tubular member is moved axially upwardly toward said dome shaped portion.

11. The assembly of claim 10 wherein said shell includes a pair of spaced generally parallel rails extending from a generally flat side thereof, said passage opening located intermediate said rails, said rails extending from said side of said shell by a distance generally equal to the extension of said tubular member from said lower portion bottom surface whereby when said shaft extends from said generally flat side of said shell and said fastener is fully attached to said shaft, said bottom surface is engageable with said rails and said rails, said side and said bottom surface will define a pair of opposed slots terminating at said cam surface.

12. The assembly of claim 10 wherein said dome shaped portion includes a generally flat upper surface generally parallel to said lower portion bottom surface.

13. A monitoring system for detecting the unauthorized movement of an article out of a predetermined area said system comprising:

a monitor actuating device which will actuate a monitor if moved beyond the predetermined point;

a pin member attachable to the monitor actuating device having a shaft for piercing a monitored article;

a reusable fastener for selective attachment to the free end of the shaft to capture the monitored article on the shaft; and a specialized tool mounted at a point within the predetermined area, said fastener designed for release for said shaft only upon the use of said tool;

said fastener comprising:

a generally hollow body having an upper generally dome shaped portion and a lower portion, said lower portion defining a bore opening to the bottom of said lower portion for receipt of the shaft, said lower portion including a generally tubular member at least partially defining the bore adjacent the opening thereto, said tubular member being axially movable relative to the dome shaped portion, said tubular member having an outer cam surface tapered radially inwardly and towards the opening to the bore, radially inwardly directed force on said cam surface being effective to move said member towards said dome shaped portion;

the bottom of said lower portion including a generally flat bottom surface extending generally normally to the axis of the bore, a portion of said tubular member extending axially downwardly from said generally flat bottom surface, said cam surface being located on that portion of the tubular member extending downwardly from said generally flat bottom surface; and a resilient one-piece spring steel clip mounted within said body, said clip having a base axially fixed and freely rotatable relative to said dome shaped portion and a resilient cantilever mounted tongue extending towards said opening to said bore, said tongue normally defining an acute included angle with a plane normal to the axis of the bore, said tongue having an aperture therethrough sized to receive said shaft, said aperture being only partially registered with said bore and having a projection on a plane normal to the axis of the bore having at least one dimension smaller than the corresponding cross-sectional dimension of the shaft to be received when the tongue is in the undeformed position, said aperture substantially registering with the bore normal to the axis of the bore at least as large as the cross-section of the shaft to be received when the tongue is deformed to be substantially normal to the axis of the bore, said base being generally annular in cross-section and the axis of rotation thereof being substantially coaxial with the axis of the bore, said aperture being at least partially registered with the axis of rotation of said base, said axially movable tubular member being engageable with said tongue to urge said tongue upwardly towards a normal to axis of the bore position when said tubular member is moved axially towards said dome shaped portion, said tool comprising a first member engageable with the top of said dome shaped portion to prevent axial movement thereof and a pair of jaws selectively movable towards one another for selectively applying a radially inwardly directed force on said cam surface.

14. The system of claim 13 wherein said dome shaped portion includes a generally flat upper surface for engagement with said first member.

15. The system of claim 13 wherein said jaws have tapered surfaces on the oppossed ends thereof complementary to said cam surface.

16. The device of claim 13 wherein said monitor actuating device comprises a shell in which a monitor actuating means is encapsulated having at least one generally flat surface, a pair of generally parallel rails extending from said shell flat surface, said pin extending from said shell flat surface intermediate said rails, said rails extending from said shell flat surface by a distance generally equal to the extension of said tubular member below said generally flat bottom surface whereby said bottom surface, said rails and said shell flat surface will define a pair of opposed slots terminating at said cam surface when said fastener is fully attached to said shaft, said jaws having a cross-section sized for slidable receipt within said slots.

17. A reusable fastener for attachment to the end of a shaft, said fastener comprising:

a body having an upper and a lower portion, said lower portion defining a bore opening to the exterior surface of the lower portion for receipt of the shaft, said lower portion including a member being axially movable relative to the upper portion and having an outer cam surface tapered radially inwardly and away from the upper portion, radially inwardly directed force on said cam surface being effective to move said axially movable member towards said upper portion; and a resilient spring steel clip mounted within said body, said clip including a base axially fixed and freely rotatable relative to said body, said clip having a first, nondeformed position for locking engagement with a shaft inserted into said bore and a second resiliently deformed position for release of a shaft inserted into said bore, said axially movable member being engageable with said clip to urge said clip towards its said second position when said member is moved towards said upper portion.

18. The fastener of claim 17 wherein a portion of said bore is formed in said axially movable member.

19. The fastener of claim 18 wherein said body comprises at least two molded pieces joined by ultrasonic welding.

20. The fastener of claim 17 wherein said upper portion is generally dome shaped and includes a generally flat surface diametrically opposed the opening to the bore.

21. A reusable fastener for attachment to the end of a shaft, said fastener comprising:

a body having an upper portion and a lower portion, said lower portion defining a bore opening to the exterior surface of the lower portion for receipt of the shaft, said lower portion including a member being axially movable relative to the upper portion and having an outer cam surface tapered radially inwardly and away from the upper portion, radially inwardly directed force on said cam surface being effective to move said axially movable member towards said upper portion; and a resilient, one-piece, spring steel clip mounted within said body, said clip being freely rotatable relative to said body, said clip having a base axially fixed relative to the upper portion and a resilient cantilever mounted tongue extending towards said opening to said bore, said tongue normally defining an acute included angle with a plane normal to the axis of the bore, said tongue having an aperture therethrough sized to receive said shaft, said aperture being only partially registered with said bore and having a projection on a plane normal to the axis of the bore having at least one dimension smaller than the corresponding cross sectional dimension of the shaft to be received when the tongue is in the undeformed position, said aperture substantially registering with the bore and having a projection on a plane normal to the axis of the bore at least as large as the cross section of the shaft to be received when the tongue is deformed to be substantially normal to the axis of the bore, said axially movable member being engageable with said tongue to urge said tongue toward a substantially normal to axis of the base position when said member is moved towards said upper portion.

22. The fastener of claim 21 wherein said base is generally round and said aperture is at least partial registered with the axis of rotation of said base.

23. The fastener of claim 22 wherein said tongue is formed in said clip by means of a generally U shaped slot formed in said clip.

24. The fastener of claim 21 wherein a portion of said bore is formed in said axially movable member.

25. The fastener of claim 24 wherein said body comprises at least two molded pieces joined by ultrasonic welding.

26. The fastener of claim 21 wherein said upper portion is generally dome shaped and includes a generally flat surface diametrically opposed the opening to the bore.

27. The fastener of claim 21 wherein said aperture is generally round.

* * * * *

UNITED STATES PATENT AND TRADEMARK OFFICE

CERTIFICATE OF CORRECTION

PATENT NO. : 4,000,543

DATED : January 4, 1977

INVENTOR(S) : Joseph H. Paskert

It is certified that error appears in the above-identified patent and that said Letters Patent are hereby corrected as shown below:

| | |
|---|---|
| In the Abstract, lines 13 & 14: | "for the pin" should read ---from the pin---. |
| Col. 5, line 57: | "s" should read---as---. |
| Col. 10, line 17: | "for said shaft" should read ---from said shaft---. |

Signed and Sealed this

Fifth Day of April 1977

[SEAL]

*Attest:*

RUTH C. MASON
*Attesting Officer*

C. MARSHALL DANN
*Commissioner of Patents and Trademarks*